United States Patent [19]

Burow

[11] Patent Number: 5,016,791

[45] Date of Patent: May 21, 1991

[54] PAINTER'S HIP LEVEL PAIL CARRIER

[75] Inventor: Charles F. Burow, Santa Maria, Calif.

[73] Assignee: Richard A. Cosca, Santa Barbara, Calif.

[21] Appl. No.: 468,767

[22] Filed: Jan. 23, 1990

[51] Int. Cl.[5] ..... A45F 3/00

[52] U.S. Cl. ..... 224/148; 224/224; 224/226; 224/904; 224/197; 224/250; 384/537

[58] Field of Search ..... 224/148, 224, 226, 242, 224/246, 247, 250, 252, 253, 272, 904, 195, 270, 197, 240, 198, 199, 907; 248/313; 220/85 H; 206/831; 384/537

[56] References Cited

U.S. PATENT DOCUMENTS

| | | | |
|---|---|---|---|
| 1,198,161 | 9/1914 | Chindgren | 224/148 |
| 2,630,651 | 3/1953 | McGee | 224/197 |
| 2,985,349 | 5/1961 | McGuire | 224/247 |
| 4,106,679 | 8/1978 | Hillinger | 224/197 |
| 4,172,542 | 10/1979 | Lankford | 224/148 |
| 4,325,503 | 4/1982 | Swinney | 224/148 |
| 4,433,801 | 2/1984 | Swinney | 224/148 |
| 4,527,720 | 7/1985 | Hayes | 224/197 |
| 4,708,273 | 11/1987 | Grant | 224/252 |
| 4,718,586 | 1/1988 | Hagino | 224/197 |
| 4,848,625 | 7/1989 | Lucia | 224/148 |
| 4,867,358 | 9/1989 | Bennis | 224/226 |

*Primary Examiner*—Henry J. Recla
*Assistant Examiner*—Keith Kupferschmid
*Attorney, Agent, or Firm*—William H. Maxwell

[57] ABSTRACT

A hip level pail carrier characterized by a girdle secured to the hips of the painter and with a bearing carried by an apron depending from the girdle to swing the pail on a horizontal axis from which the pail hangs by gravity, and preventing accidental release of the pail.

11 Claims, 2 Drawing Sheets

PAINTER'S HIP LEVEL PAIL CARRIER

BACKGROUND OF THE INVENTION

This invention relates to hip level support of paint cans, especially pails, to be used when moving upon ladders and scaffolds which requires the painter's second hand for stability while painting with his first hand. Mobility of the paint can or pail at the side of the painter is a general object of this invention.

Heretofore, various harnesses and belt supports have been employed for the aforesaid general objective However, complexity and movement limitations have made such devices difficult and impractical to use. Therefore, it is an object of this invention to provide a simple and practical hip level carrier for a painter's paint can or pail, at hip level elevation of the can or pail adjacent to the painter's thigh, this being the most advantageous position.

Comfort is a high priority requirement, and to this end it is an object of this invention to provide a girdle in the form of a wide band of heavy bodied strapping of flexible material that conforms to the changes in body configurations of the painter as he works. It is to be understood that the painter's stature and body attitudes vary drastically, and that this pail carrier must be universally applicable to all practical situations of the painter at work. That is, the pail must contain an adequate supply of paint without spilling, and in a position available to the painter's brush (a right handed arrangement being shown herein). To this end it is an object of this invention to secure the paint can or pail such that it inherently remains vertically disposed within predetermined limits during the painter's normal work, without requiring undue attention. To this end the can or pail is coupled to the girdle by an anti-friction bearing means that ensures its erect condition by means of gravity.

It is a primary object of this invention to provide reliable securement of a paint can or pail, whereby safety is ensured together with damping of and limiting of displacement of the can or pail from its optimum vertical condition. Firstly, this can or pail carrier is characterized by a band of heavy bodied strapping that encircles the can or pail beneath the bail features thereof, and utilizing hook and loop fastening means for universal securement. Secondly, the anti-friction bearing means supports said heaving band of strapping on a horizontally disposed axis of rotation projecting normal from the aforesaid girdle that is buckled to the hips of the painter, and stabilized by a depending apron or flap member engageable against the thigh of the painter for its vertical support in conformity to movements of the painter. The normal human is characteristically erect, or substantially so. And thirdly, the bail of the paint can or pail is captured by frictional engagement through a loop of belting releasably buckled immediately above the anti-friction bearing means, without encumbering the bail while providing for its capture and quick release.

SUMMARY OF THE INVENTION

The pail carrier herein disclosed is comprised of a girdle for universal application to hips of all persons and from which an apron depends with an anti-friction bearing means and to which the pail is held by straps so as to hang vertically. The pail has a semi-circular bail swivally attached to the upper portion of the pail, the bail being frictionally engaged through a buckled strap for damped swinging motion of the pail, and as a safety means securing the pail directly to the girdle. The girdle with the depending apron is more than a mere belt, in that it is made of heavy bodied strapping that not only encircles the person's hips but also conforms to a thigh at one side of the person where it is disposed in a substantially vertical plane at all times. A feature of this invention is the anti-friction bearing means of large planar configuration hinged to the lower edge of the girdle strapping, and having a horizontal axis of rotation normal to the apron that protects the person's thigh from abrasion as the pail and the holding strap move relative to the person's thigh. The large planar area of the bearing means and the close proximity of its hinged support from the girdle eliminates turning moments, and this makes for stability of heavily laden pails swinging vertically alongside of the person's thigh. Additionaly, there is the safety strap buckled to the bail, by which the pail is not only braced in a vertical position but which frictionally damps the pendulum effect of the swinging pail. Characteristically, the carrier herein disclosed is a softwear article, which is non-injurious and which is comfortable to wear while protecting the person's thigh from the presence of a heavy pail that is effectively carried in a ready to use manner.

The foregoing and various other objects and features of this invention will be apparent and fully understood from the following detailed description of the typical preferred form and application thereof, throughout which description reference is made to the accompanying drawings.

THE DRAWINGS

Figure 6:
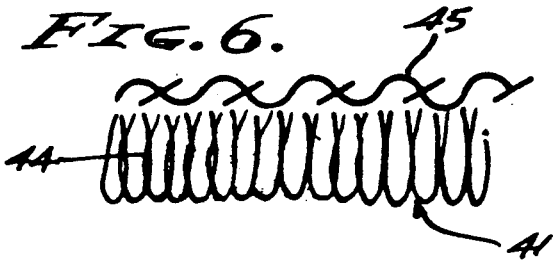
Figure 7:
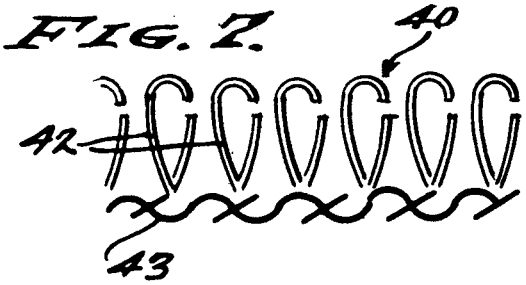

And FIGS. 6 and 7 are enlarged fragmentary views of hook-and-loop fastening means as it is employed herein.

PREFERRED EMBODIMENT

Referring now to the drawings, the pail carrier is adapted to be worn by a painter person, to encircle his pelvic girdle or hips at or below the waste, and much the same as a belt is worn with buckle adjustment over the abdomen. Accordingly, this carrier is characterized by a girdle G in the form of a flexible band of heavy bodied strapping that encircles the person's hips and adjustably secured by means of a buckle. A feature is the apron A in the form of a flexible flap of heavy bodied strapping that depends from the girdle G at one side thereof, for example over the right hip of the person (a right handed embodiment as shown). Anti-friction bearing means B is supported by the apron A to rotatably carrier pail securement means C in the form of heavy bodied strapping that encircles a pail P beneath the bail features thereof, as will be described. Another feature of this invention is a safety and motion damper means D that advantageously employs the bail of the paint pail P, without encumbering the pail while providing for its capture and quick release.

A typical gallon size paint pail P is illustrated, with a vertically disposed cylindrical side wall 11 closed by a bottom wall (not shown) and open at a top seal-bead or rim 12 by a removable lid (not shown). Note the partially filled condition of the pail, approximately less than half full. As shown, the pail P has a bail 13 comprised of a semi-circular member of heavy wire that extends arcuately over the top rim 12 to swing freely between diametrically opposite trunnions 14. The opposite trunnions are disposed below the rim 12 on a common axis a, and each is a hat-shaped part as shown secured permanently to the side wall 11 and with an opening in its top to receive an inwardly turned end 15 of the bail 13. The bail 13 swings clear of the rim 12 a substantial distance, as shown.

The girdle G is the attachment means by which this carrier is secured to the person of the painter, to encircle his pelvic girdle with snug engagement over his hips. The girdle G is flexible for compliance to body contours of the person and is made of heavy bodied strapping or the like, shown in the drawings as an envelope of heavy woven fabric 16 containing a core 17 of foamed plastic or the like. The girdle G is characterized by a back portion 18 of substantial vertical height and of a length to extend throughout approximately half the circumference of an average paint person's waste. Accordingly, the opposite ends 19 and 19' are extended by flexible belting 20 and 20' by which they are drawn together by releasable buckle means 21 and 21'. The buckle means are adjustable on the belting. The fabric 16 envelope is secured together by stitching 22 applied through binding 23, and the belting 20 and 20' is secured by stitching 24. The girdle G is adjusted to the girth of the painter person's waste or hips, and secured by coupling the buckle means 21 and 21'.

The apron A is a flap secured to the lower edge of the girdle G to depend therefrom at one side of the person and contiguous to his thigh. Accordingly, the apron A is secured by stitching 30 to the end portion of the girdle G (to the right end portion for a right handed embodiment as shown). The apron is flexible for compliance to body contours of the painter person and is made of heavy bodied strapping or the like, shown in the drawings as an envelope of heavy woven fabric 26 containing a core 27 of foamed plastic or the like. The apron A is a support and protector that extends downwardly to engage the side wall 11 of the paint pail P, as clearly shown in the drawings. That is, the paint pail P rests and/or bears against the apron A, and it rubs thereagainst when swinging movement of the pail occurs, or as the painter's body positions vary. The fabric 26 envelope is secured together by stitching 28 applied through binding 29. The apron A lies contiguously against the thigh of the painter person, well below his waste level.

Figure 5:
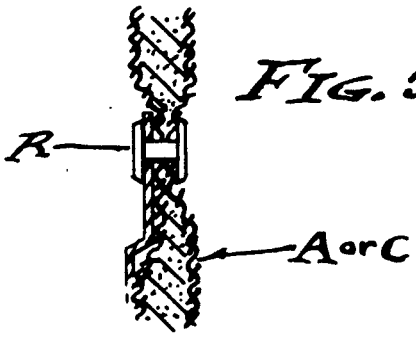
FIG. 5 is a fragmentary sectional view taken as indicated by line 5—5 on FIG. 4.
Figure 4:
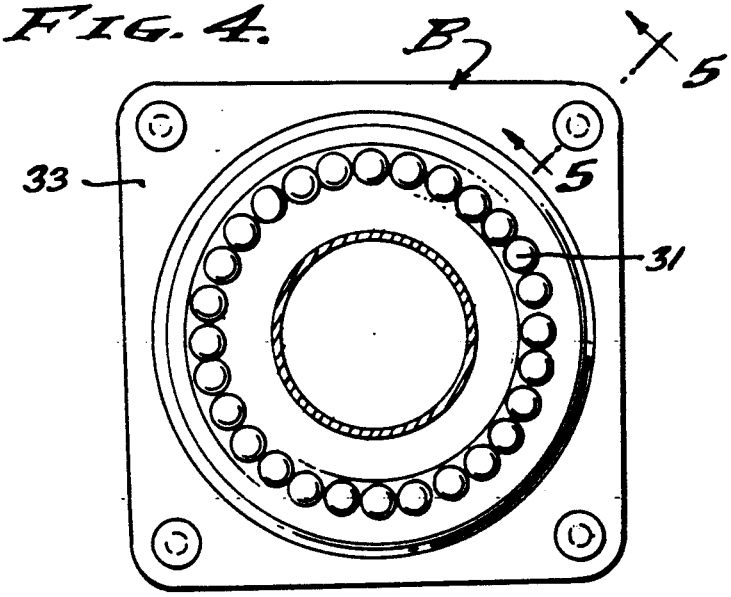
FIG. 4 is a detailed sectional view taken as indicated by line 4—4 on FIG. 3.

Referring now to the anti-friction bearing means B, it is a feature of this invention that the paint pail P is suspended to swing on a horizontal axis b disposed normal to the paint person's thigh. To this end the means B is stabilized axially in order to ensure said horizontal disposition of the axis b. Horizontal stability is achieved within a minimized axial distance by employing a large diameter perimeter thrust bearing. That is, the axial thrust is applied at a substantial radius from the turning axis b. The preferred bearing means B is anti-friction balls 31 carried between circular races of opposed plates 32 and 33 rotatably coupled by inner diameter flanges 34 and 35. As shown, the inner diameter flange 35 of plate 33 is turned loosely over the inner diameter flange 34, whereby plates 32 and 33 turn free with the balls 31 captured to receive axial thrust. As shown in FIG. 5, the plate 33 is secured to the apron A as by means of rivets R, with the axis b of the bearing means B projecting horizontally and normal from the painter person's thigh. The anti-friction balls operating in the races of the opposed plates 32 and 33 establishes the axis of rotation and of plate 32 that carries the pail securement means C next described. A feature of this invention is the position of the swinging axis b well above the center of gravity of pail P, especially when laden with liquid as shown.

Figure 1:
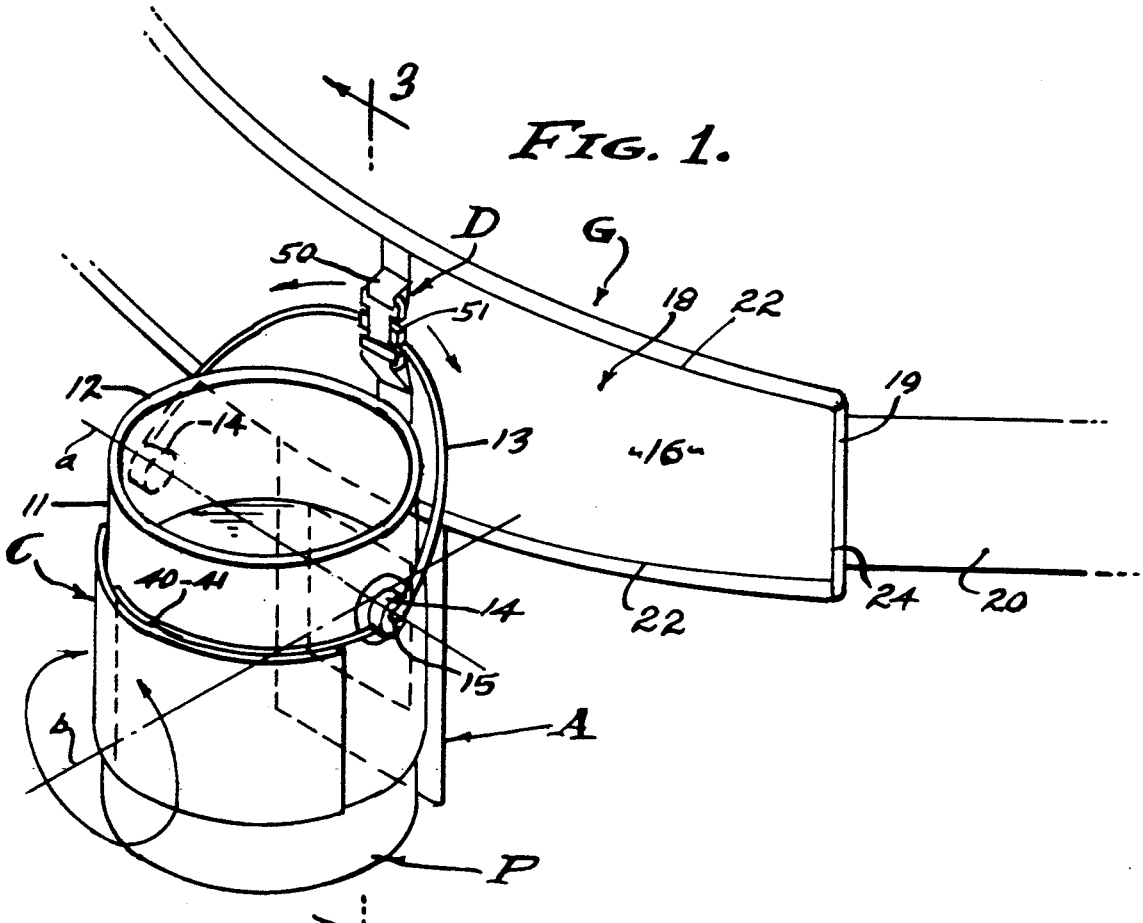
FIG. 1 is a perspective view of a paint pail secured to a side of the carrier of the present invention.
Figure 2:
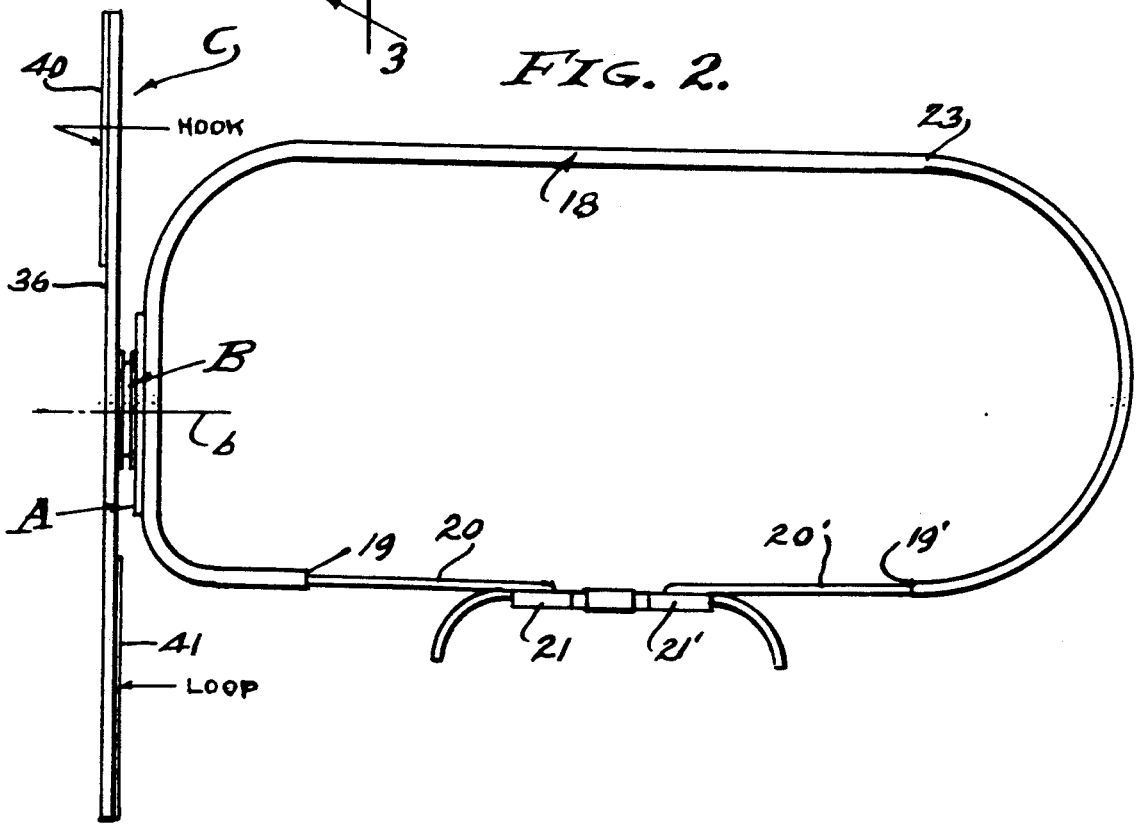
FIG. 2 is a plan view of the carrier alone, with the pail removed.
Figure 3:
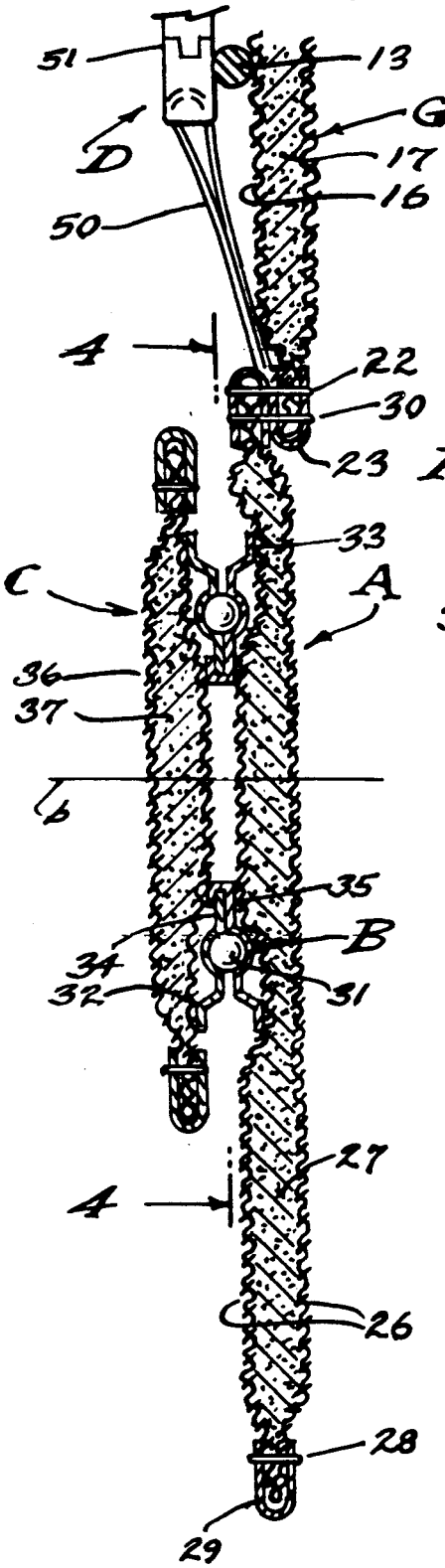
FIG. 3 is an enlarged section view taken as indicated by line 3—3 on FIG. 1.

The pail securement means C is secured to the freely rotatable plate 32 of the bearing means B in order to carry the paint pail P. In its preferred form, the means C, like the girdle G and apron A, is a flexible heavy bodied strapping or the like, shown in the drawings as an envelope of heavy woven fabric 36 containing a core 37 of foamed plastic or the like. In practice, this strapping is approximately four inches wide and twenty seven inches in length, the opposite end portions thereof having a substantial overlap of approximately ten inches when embracing a one gallon paint can or pail as shown. A feature of this invention is the use of hook and loop fastener means as clearly shown in FIGS. 6 and 7 of the drawings. Referring to FIG. 2 it will be seen that the hook element 40 of FIG. 7 is coextensively applied to the outside face of the strapping 36 and that the loop element 41 of FIG. 6 is coextensively applied to the inside face of said strapping. As shown in FIG. 5, the plate 32 is secured to the strapping 36 of securement means C as by means of rivets R applied therethrough. The rivets R are preferably tubular rivets.

The hook element 40 and loop element 41 as shown in FIGS. 6 and 7 are "VELCRO" as manufactured by Velcro USA INC. of 618 Fifth Avenue, New York, N.Y., 10022, or "Scotchmate" as manufactured by 3M Company, St. Paul, Minn. 55101, or the like. The hook element 40 (see FIG. 7) of the fastener means is comprised of a closely arranged multiplicity of minute hooks 42 extending coextensively over and uniformly a short distance from a backing tape 43. The loop element 41 (see FIG. 6) of the fastener means is comprised of a loop pile of minute loops of fibers 44 of uniform weight, thickness and density, coextensively overlying backing tape 45. In carrying out this invention, the desired orientation of the flat sided elements 40 and 41 is determined and the hook-and-loop elements pressed into contiguous engagement one with the other for a press fit securement having its greatest strength in lateral shear.

The safety and motion damper means D advantageously captures the bail 13 of the paint pail P so that the pail cannot drop in the event that the securement means slips or fails, and so that swinging of the pail is frictionally damped and limited. The means D receives the bail 13 and holds it secure against the girdle G and away from the open top end of the pail P. In its preferred form, the safety and motion damping means D is a vertically disposed belt 50 and releasable buckle means 51, carried by the girdle strapping 16 and directly over or above the swing axis b of rotation. The opening behind the buckle means 51 is at an elevation to receive the bail 13 when positioned against the girdle as shown. The friction imposed by the safety belt and buckle 50–51 increases with angular displacement of the pail, due to the arcuate shape of the bail that ultimately stops the swinging motion at more or less 30° to 45°. The paint pail P swings freely by gravity, as a pendulum, on the rotational axis b, with adequate but restricted motion damped by the means D.

From the foregoing it will be understood how the paint pail carrier of the present invention is constructed and worn, made of flexible strapping with a depending apron that protects the wearer from abrasion by the pail supported thereby on a horizontal swinging axis by anti-friction bearing means. The girdle G is first adjusted to the hips of the wearer by securing the buckle means 21 and 21' with the protective apron A depending contiguous to one side hip of the wearer. The contiguous engagement of the apron A with the wearer's thigh stabilizes the anti-friction bearing means B with the axis b thereof projecting horizontally and normal from the wearer's thigh. The paint pail P with its liquid content is then positioned with its bail trunnions 14 at and immediately above the top edge of the strapping 36 of securement means C, whereupon the end portions of said strapping with the hook-and-loop fastener means are overlapped and pressed together for securement. The paint pail P cannot fall or drop because of the inherent abuttment presented by the trunnions 14. The safety and motion damper means D is then fixedly secured by engaging the belt and buckle means 50 and 51 over the bail 13, thereby positively anchoring the paint pail P to the girdle G, while permiting swinging thereof on axis b and damped by frictional engagement with the bail with the belt and buckle 50 and 51 and with limited angular displacement restricted to approximately 45°, more or less.

Having described only the typical preferred form and application of our invention, we do not wish to be limited or restricted to the specific details herein set forth, but wish to reserve to ourselves any modifications or variations that may appear to those skilled in the art as set forth within the limits of the following claims.

I claim:

1. A hip level carrier for swinging a vertically disposed open topped pail on a horizontal axis, and including;

a girdle of flexible strapping for encircling the hips of a person at waste level, a substantial flat apron of flexible strapping depending from one side of the girdle to overly the thigh of said person for stabilized support when contiguously engaged against said thigh, an anti-friction bearing means having a horizontally disposed axis projecting normal from the flat apron and supporting thigh, said bearing means having a first plate member secured to the flat apron and a second plate member rotatable on said axis, and with a bearing carried in opposed circular races of said first and second plate members for free rotation of said second plate member, and pail securement means on the second plate member and carrying the pail with the pail's center of gravity below said horizontally disposed axis.

2. The hip level carrier for a pail set forth in claim 1, wherein the flexible girdle strapping is secured to the hips of the person by adjustable belting and buckle means.

3. The hip level carrier for a pail as set forth in claim 1, wherein the first plate member of the bearing means has a member secured to the apron and secures the second plate member rotatable on said axis.

4. The hip level carrier for a pail as set forth in claim 1, wherein the bearing carried in said opposed circular races are ball bearings.

5. The hip level carrier for a pail as set forth in claim 1, wherein the pail has a bottom and side walls, and wherein the pail securement means is flexible strapping embracing the side walls of the pail with releasable fastener means therefor.

6. The hip level carrier for a pail as set forth in claim 1, wherein the pail has a bottom and side walls, and wherein the pail securement means is flexible strapping embracing the side walls of the pail with releasable hook-and-loop fastener means adjustably securing overlapped end portions thereof.

7. The hip level carrier for a pail as set forth in claim 1, wherein the flexible girdle strapping is secured to the hip of the person by adjustable belting and buckle means, wherein the pail has a bottom and side walls, and wherein the pail securement means is flexible strapping embracing the side walls of the pail with releasable hook-and-loop fastener means adjustably securing overlapped end portions thereof.

8. A hip level carrier for damped swinging of a vertically disposed open topped pail having a bail rotatable on a trunnion axis at the top portion thereof, and including;

a girdle of flexible strapping for encircling the hips of a person at waste level, a substantially flat apron of flexible strapping depending from one side of the girdle to overly the thigh of said person for stabilized support when contiguously engaged against said thigh.

an anti-friction bearing means having a horizontally disposed axis projecting normal from the flat apron and supporting thigh, said bearing means having a first plate member secured to the flat apron and a second plate member rotatable on said axis and with ball bearings carried in opposed circular races of said first and second plate members for free rotation of said second plate member, pail securement means on the second plate and carrying the pail with the pail's center of gravity below said horizontally disposed axis, and pail motion damping means carried by the girdle strapping directly above the bearing means axis and frictionally engaging the bail.

9. The hip level carrier for damped swinging of a pail as set forth in claim 8, wherein the motion damping means is a vertically disposed belting and releasable buckle means engageable with and over the bail.

10. The hip level carrier for damped swinging of a pail as set forth in claim 8, wherein the pail has a bottom and side walls, and wherein the pail securement means is flexible strapping embracing the said walls of the pail with releasable hook-and-loop fastener means and adjustably securing overlapped end portions thereof.

11. The hip level carrier for damped swinging of a pail as set forth in claim 8, wherein the flexible girdle strapping is secured to the hips of the person by adjustable belting and buckle means, wherein the pail has a bottom and side walls, wherein the pail securement means is flexible strapping embracing the side walls of the pail with releasable hook-and-loop fastener means adjustably securing overlapped end portions thereof, and wherein the motion damping means is a vertically disposed belting and releasable buckle means engageable with and over the bail.

* * * * *